United States Patent [19]

Allemandou

[11] Patent Number: 4,649,628

[45] Date of Patent: Mar. 17, 1987

[54] METHOD FOR CRIMPING A TUBE END PLATE OF A HEAT EXCHANGER ON A HEADER BOX AND HEAT EXCHANGER OBTAINED THROUGH THIS METHOD

[75] Inventor: Michel Allemandou, Charenton le Pont, France

[73] Assignee: Societe Anonyme des Usines Chausson, Asnieres Hauts de Seine, France

[21] Appl. No.: 675,872

[22] Filed: Nov. 28, 1984

[30] Foreign Application Priority Data

Dec. 9, 1983 [FR] France ..... 83 19757

[51] Int. Cl.[4] ..... F28D 1/00; F28F 9/02; B21D 53/00; B21D 39/03

[52] U.S. Cl. ..... 165/148; 29/157.3 R; 29/33 G; 29/462; 29/509; 165/173; 403/274; 403/284

[58] Field of Search ..... 29/157.3 R, 157.3 D, 29/157.4, 462, 463, 505, 509, 510, 516, 511, 513, 33 G; 403/284, 274, 285; 165/173, 175, 149, 148

[56] References Cited

U.S. PATENT DOCUMENTS

| | | | |
|---|---|---|---|
| 1,181,262 | 5/1916 | Schock et al. | 29/510 X |
| 4,305,459 | 12/1981 | Nonnenmann et al. | 165/173 |
| 4,324,270 | 4/1982 | Moranne | 165/173 |
| 4,331,201 | 5/1982 | Hesse | 165/173 X |
| 4,455,728 | 6/1984 | Hesse | 165/157.4 X |
| 4,531,578 | 7/1985 | Stay et al. | 165/175 |

FOREIGN PATENT DOCUMENTS

| | | | |
|---|---|---|---|
| 0054815 | 6/1982 | European Pat. Off. | 165/149 |
| 2816291 | 10/1979 | Fed. Rep. of Germany | 29/157.4 |
| 3312691 | 10/1983 | Fed. Rep. of Germany | 165/149 |
| 2037203 | 7/1980 | United Kingdom | 403/274 |
| 2090958 | 7/1982 | United Kingdom | 165/151 |

*Primary Examiner*—Howard N. Goldberg
*Assistant Examiner*—Ronald S. Wallace
*Attorney, Agent, or Firm*—Browdy and Neimark

[57] ABSTRACT

In a method for crimping a tube end plate of a heat exchanger on a header box, there is provided a peripheral upright edge for enclosing an extra thickness defined by the header box. Portion of the upright edge of the tube end plate which has to extend, when assembled, at least in part above a flange of the header box is stiffened. The stiffened portion of the upright edge of the tube end plate is folded at least partly back onto the flange of the header box.

15 Claims, 8 Drawing Figures

METHOD FOR CRIMPING A TUBE END PLATE OF A HEAT EXCHANGER ON A HEADER BOX AND HEAT EXCHANGER OBTAINED THROUGH THIS METHOD

FIELD OF THE INVENTION

The present invention relates to a new method for crimping a header box in a tube end plate of a heat exchanger in such a manner that the header box compresses a deformable gasket providing a perfect tightness between the tube end plate and the header box.

BACKGROUND OF THE INVENTION

In the known technique, the crimping of the header box is most often realized by means of lugs protruding from the peripheral upright edge of the tube end plate, these lugs being folded back onto a protruding flange formed on the header box.

INFORMATION DISCLOSURE STATEMENT

The hereabove technique is practiced in particular in French Pat. No. 79-09343, in French Pat. No. 83-05785 as well as in French Pat. No. 1,039,911. In some cases, the folded lugs are reinforced by ribs. This is the object of the European patent application No. EP-A-0,054,815.

This arrangement which is largely used has the disadvantage that the lugs work in flexion and that at the moment the lugs are folded they can, sometimes, cause deformations of the upright edge of the tube end plate from which they protrude, with the result that these deformations can impair the tightness between the tube end plate and the header box.

In order to remedy the above disadvantage, Applicant has proposed in French Pat. No. 69-24782 to provide a header box-tube end plate connection made by means of fastening members protruding in the peripheral edge of the header box and by engaging these fastening members in openings of the upright edge of the tube end plate. Similar arrangements are also disclosed in French Pat. No. 79-29548.

Such an arrangement is satisfactory since the metal works in traction, but setting in place the header box sometimes causes relatively difficult problems, according to the nature of the metal of the tube end plate. It is actually possible, if the metal of the tube end plate is resilient, to provide a snap-in fitting but, if the metal is not resilient, the upright edge of the tube end plate has first to be flared out and then shrunk against the header box while maintaining this header box under pressure.

OBJECT OF THE INVENTION

The present invention relates to a realization for obtaining the same advantageous results as those produced by an introduction of fastening members protruding from the header box and extending through openings formed in the upright edge of the tube end plate, while permiting an easy mounting of the header box, whatever the nature, and particularly the resiliency of the metal constituent of the tube end plate.

SUMMARY OF THE INVENTION

According to the invention, the method for crimping a tube end plate of a heat exchanger on a header box in which there is provided a peripheral upright edge for enclosing an extra thickness defined by the header box, comprising the step of creating in the peripheral upright edge of the tube end plate, substantially at a level of the header box, a line of lesser resistance, stiffening a portion of the peripheral upright edge of the tube end plate which extends above the line of lesser resistance so stiffened, and folding the portion of the upright edge of the tube end plate such that the upright edge is at least partly folded back on the flange of the header box.

The invention applies also to a heat exchanger obtained according to the hereabove method. According to this second arrangement of the invention, the heat exchanger is of the tube and heat dissipator type with the tubes opening into at least one tube end plate which is covered by a header box crimped by a peripheral upright edge of the tube end plate; The upright edge of the tube end plate has; on a major portion at least of its periphery, a line of lesser resistance, stiffening means are provided on the upright edge above the line of lesser resistance, and the stiffening means are at least partly folded back on a peripheral edge of the header box in a position for which a heel portion of the header box compresses a deformable gasket.

Various other features of the invention will become more apparent from the following detailed description.

BRIEF DESCRIPTION OF THE DRAWINGS

Embodiments of the invention are shown by way of non limiting examples in the accompanying drawings, wherein.

DESCRIPTION OF THE PREFERRED EMBODIMENT

Figure 1:
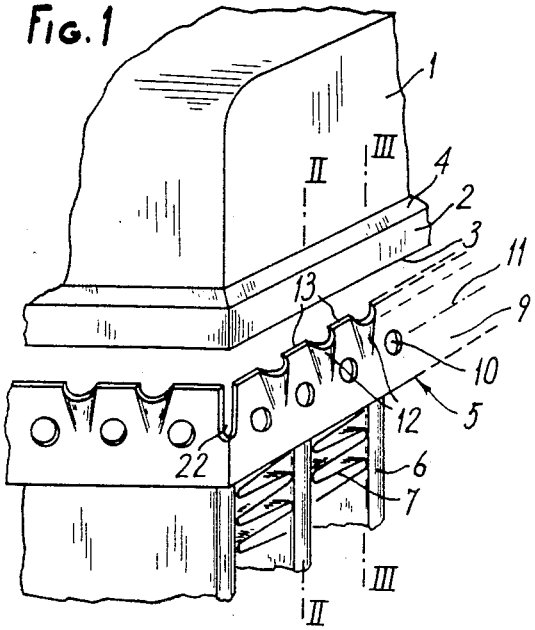
FIG. 1 is a partly exploded partial perspective view of a heat exchanger embodying the invention.

In the drawings, reference numeral 1 designates a header box of a heat exchanger. The header box 1 is made of a molded material, for example a synthetic material or a metal, and defines at its lower portion an extra thickness 2. The extra thickness 2 is formed on the whole periphery of the header box and delimits a lower portion 3 and an upper flange 4.

The header box 1 is provided for covering a metal tube end plate 5 in which ends of tubes 6 are tightly connected, with heat dissipators in the form of corrugated fins 7 being interposed between the tubes 6. The tube end plate 5 defines a peripheral groove or gutter 8.

The peripheral upright edge 9 of the tube end plate 5 is provided, substantially at the position that the flange 4 of the header box has finally to occupy, with a row of holes or openings 10 for creating a line of lesser resistance shown at 11 in the drawings.

A plurality of waves 12 are formed above the line 11 of lesser resistance, the waves 12 leaving therebetween a succession of substantially planar portions 13 which are in the same vertical plane as the inner face of the upright edge 9.

Figure 2:
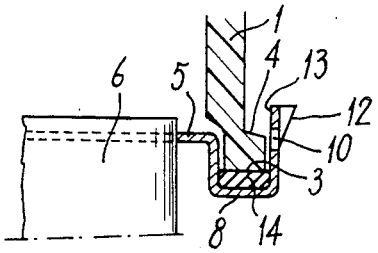
FIG. 2 is a sectional view of the part of FIG. 1 taken substantially along line II—II of FIG. 1.
Figure 3:
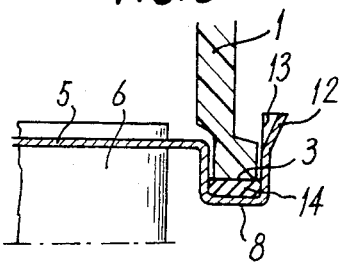
FIG. 3 is a sectional view of a part of FIG. 1 taken substantially along line III—III of FIG. 1.

FIGS. 2 and 3 thus show that the waves 12 leaves completely clear the peripheral groove 8 of the tube end plate, thereby permitting an easy fitting of the extra thickness 2 of the header box 1 in the peripheral groove 8, after having placed therein a deformable flexible gasket 14. The waves 12 have for their effect to stiffen the upper portion of the upright edge 9 above the line 11 of lesser resistance.

Figure 6:
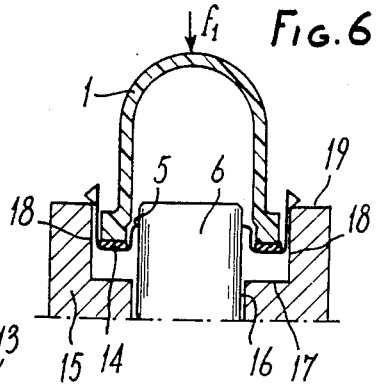
FIG. 6 is a diagrammatic sectional view showing the working operation during which the tube end plate is crimped onto the header box.
Figure 7:
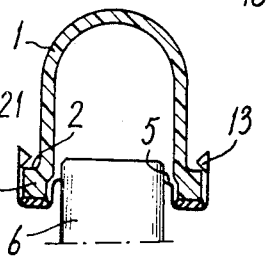
FIG. 7 is a cross sectional view, similar to FIG. 5, showing, after crimping, the relation between the tube end plate and the header box.

In order to crimp a tube end plate 5 on the header box 1, a tool is used which is designated as a whole by reference 15 in FIG. 6. As shown, the tool 15 defines a passage 16 for the tubes 6 and heat dissipators 7 and forms, in its upper portion, a shoulder 17 above which extend the crimping walls 18. The height of the crimping walls 18 is greater than the height of the upright edge 9 of the tube end plate 5.

As shown in the drawings, the tube end plate 5 to which are fixed the tubes 6 and heat dissipators 7 is engaged into the tool 15 (FIG. 6) up to the waves 12 come in abutment against the top 19 of the tool 15.

Unless already done, the flexible gasket 14 is fitted into the peripheral groove 8 of the tube end plate. Then the header box 1 is engaged in the peripheral groove 8 in such a manner that the heel portion 3 of the extra-thickness 2 of the header box 1 comes to bear against the gasket 14. A pressure in direction of the arrow $f_1$ is then exerted on the header box 1. The pressure has first for effect to compress the gasket 14 in the bottom of the peripheral groove 8, then, the pressure being still exerted, a progressive deformation of the portion of the upright edge 9 appears at the line 11 of lesser resistance. This deformation is caused by the waves 12 which slide along the crimping walls 18 of the tool 15 and therefore cause the substantially planar portions 13 of the upright edge 9 to tilt towards top of the flange 4 of the extra thickness 2 of the header box 1. The deformation goes on until the outer walls of the waves 12 are brought in a substantially vertical plane. Therefore, the waves 12 have a cam effect.

In this arrangement, the holes or openings 10 defining the line 11 of lesser resistance cover the side edge of the flange 4 which is thus, partly at least, enclosed while the portions 13 are folded back on the top of the flange 4.

Figure 4:
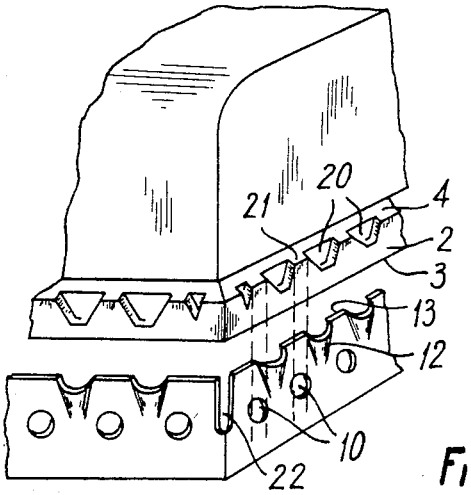
FIG. 4 is a partly exploded partial perspective view, similar to FIG. 1, showing a variant.
Figure 5:
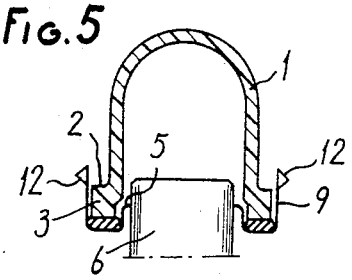
FIG. 5 is a diagrammatic cross sectional view of a particular position of a tube end plate and of a header box prior to the working operation shown in FIG. 6.
Figure 8:
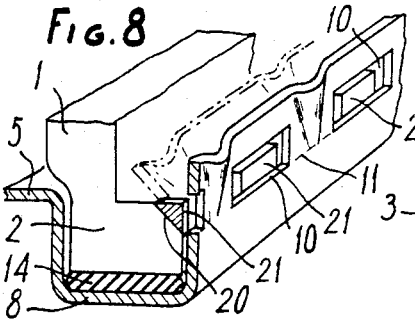
FIG. 8 is a perspective view of an alternative embodiment.

FIGS. 4 and 8 show slight variations according to which notches 20 are formed in the flange 4 in order to define teeth 21 therebetween, the teeth 21 being provided to be in register with the holes 10 of the tube end plate. As shown in FIG. 8, it is advantageous that the holes 10 have a diameter (if they are of a round shape) or a width (if they are of an oblong, rectangular or trapezoidal shape), which is superior to width of the teeth 21 in order to compensate for the manufacturing tolerances existing between the header box and the tube end plate. The line 11 of lesser resistance is then substantially at the base of the teeth 21.

Since the teeth 21 are registered with the holes 10 at the end of the crimping operation, the teeth 21 are inserted into the holes 10 and, therefore, the connection provided by the mutual engagement of the parts is reinforced to a greater degree.

Although not necessary, it is advantageous, in order to make the crimping operation easier, to provide slits or notches 22, for example at the four corners of the upright edge 9 of the tube end plate.

The invention is not limited to the embodiments shown and described in detail and various modifications can be made without departing from the scope of the invention as shown in the appendent claims. Particularly, the slits or notches 22 can be replaced by waves which are compressed at the moment of the crimping operation. Likewise, the line of lesser resistance can be defined in a different way than by opening; it is possible that they are formed by a thinned out portion, for example a continuous or discontinuous groove of the tube end plate. It is also possible that the openings be connected by a portion of lesser resistance, particularly when the header box forms teeth 21.

What is claimed is:

1. A heat exchanger of the tube and heat dissipator type with the tubes opening into at least one tube end plate which is covered by a header box crimped by a peripheral upright edge of the tube end plate, wherein the upright edge of the tube end plate has, at least along a major portion of its periphery, a line of lesser resistance, wherein stiffening means, having camming surfaces engagable with a crimping tool, are provided in the upright edge solely above the line of lesser resistance, and wherein, as the camming surface engage the tool, the upright edge of said tube end plate, including said stiffening means, is folded back on a peripheral flange of the header box substantially around said line of lesser resistance in a position at which a heel portion of said header box is maintained so as to compress a deformable gasket.

2. A heat exchanger according to claim 1, wherein the stiffening means are made of waves separated by substantially flat portions.

3. A heat exchanger according to claim 1, wherein the line of lesser resistance is defined by holes or openings.

4. A heat exchanger according to claim 3, characterized by teeth formed by the header box in register with said holes or openings.

5. A heat exchanger according to claim 4 wherein the stiffening means are made of waves separated by substantially flat portions, and wherein said teeth are defined by notches for passage of said substantially flat portions during insertion of said teeth in said holes or openings.

6. A heat exchanger according to claim 4, wherein said teeth have a width which is smaller than a diameter or width of said holes or openings.

7. A heat exchanger according to claim 1, wherein at least one slit or notch is provided in each upright edge and extends up to vicinity of the line of lesser resistance.

8. A heat exchanger according to claim 1, wherein at least one wave is provided in each upright edge and extends up to vicinity of the line of lesser resistance.

9. A method for crimping a tube end plate of a heat exchanger on a header box, the tube end plate being provided with a peripheral upright edge and the header box having a corresponding peripheral extra-thickness with a flange, comprising the steps of:

providing a line of lesser resistance in the peripheral upright edge of the tube end plate, stiffening only that portion of said peripheral upright edge of the tube end plate which extends above said line of lesser resistance so that a camming effect may occur when contacted by an appropriate tool, and bending the stiffened portion of said peripheral upright edge at least partly back into a position so that said stiffened portion overlies said header box flange and compresses a deformable gasket.

10. A method according to claim 9, wherein the step of stiffening only that portion of said peripheral upright edge of the tube end plate which extends above said line of lesser resistance comprises forming therein outwardly protruding waves defining substantially flat portions extending vertically between said waves.

11. A method according to claim 10, wherein the step of bending back the stiffened portion of the peripheral upright edge of said tube end plate comprises placing said peripheral upright edge into a tool having crimping walls with a spacing corresponding to the spacing of an outer face of various plane sides of said upright edge, positioning a deformable gasket in the tube end plate, positioning the header box in such a manner that a heel portion thereof bears on said gasket, exerting a pressure on the header box to deform the gasket, and then bending back the outwardly protruding waves and the flat portions extending therebetween toward a flange of the header box, with the gasket being still kept under pressure.

12. A method according to claim 9, and further comprising the step of forming the flange of said extra-thickness of the header box with an edge, the step of providing the line of lesser resistance in the peripheral upright edge of the tube end plate comprising forming holes or openings in the peripheral upright edge of the tube end plate at a level for which said edge of the flange is enclosed in said holes or openings.

13. A method according to claim 12, wherein teeth are formed in the header box in register with some at least of the holes or openings defining the line of lesser resistance, said holes or openings having a shape taken among a round, oblong, rectangular and trapezoidal shape, and said teeth having a width smaller than that of the holes of openings.

14. A method according to claim 9, and further comprising the step of forming the flange of said extra-thickness of the header box with lugs, the step of providing the line of lesser resistance in the peripheral upright edge of the tube end plate comprising forming holes or openings in the peripheral upright edge of the tube end plate at a level for which the top of said lugs is enclosed in said holes or openings.

15. A method according to claim 14, wherein teeth are formed in the header box in register with some at least of the holes or openings defining the line of lesser resistance, said holes or openings having a shape taken among a round, oblong, rectangular and trapezoidal shape, and said teeth having a width smaller than that of the holes or openings.

* * * * *